US009988768B2

(12) United States Patent
Weaver et al.

(10) Patent No.: US 9,988,768 B2
(45) Date of Patent: Jun. 5, 2018

(54) SYSTEM, METHOD, AND APPARATUS TO RESTRICT MOVEMENT OF RAILWAY GUARD BAR

(71) Applicant: PROGRESS RAIL SERVICES CORPORATION, Albertville, AL (US)

(72) Inventors: Brian F. Weaver, Burlington, KY (US); Phillip R. Merrifield, Independence, KY (US)

(73) Assignee: Progress Rail Services Corporation, Albertville, AL (US)

( * ) Notice: Subject to any disclaimer, the term of this patent is extended or adjusted under 35 U.S.C. 154(b) by 137 days.

(21) Appl. No.: 15/222,605

(22) Filed: Jul. 28, 2016

(65) Prior Publication Data

US 2018/0030661 A1 Feb. 1, 2018

(51) Int. Cl.
*E01B 5/18* (2006.01)
*E01B 9/60* (2006.01)

(52) U.S. Cl.
CPC . *E01B 5/18* (2013.01); *E01B 9/60* (2013.01)

(58) Field of Classification Search
CPC ..... E01B 9/60; E01B 9/62; E01B 5/18
USPC ..... 238/17
See application file for complete search history.

(56) References Cited

U.S. PATENT DOCUMENTS 1,566,443 A * 12/1925 Stephens ..... E01B 5/18 238/19
1,770,009 A * 7/1930 Packer ..... E01B 5/18 238/19
2,019,743 A * 11/1935 Stewart ..... E01B 5/18 238/19
4,386,751 A * 6/1983 Meyer ..... E01B 7/20 238/22
5,148,980 A * 9/1992 Fritz ..... E01B 7/20 238/17
5,176,318 A * 1/1993 Young ..... E01B 5/18 104/242
5,238,186 A * 8/1993 Young ..... E01L 35/18 104/242
6,279,833 B1 * 8/2001 Schwiede ..... E01L 35/18 238/17

(Continued)

FOREIGN PATENT DOCUMENTS

GB 2 351 514 B 2/2003
GB 2 424 439 B 6/2008

OTHER PUBLICATIONS

LB Foster Rail Products, Trackwork, available at http://www.lbfoster-railproducts.com/rail_pdf_profiles/LBF_Rail-Trackwork.pdf (Mar. 18, 2010).

*Primary Examiner* — Jason C Smith
(74) *Attorney, Agent, or Firm* — Oblon, McClelland, Maier & Neustadt

(57) ABSTRACT

The disclosure provides a guard bar restraint for restricting movement of a guard bar. The guard bar restraint includes a hook block coupled to the front face of the guard bar, a back plate configured to contact the back face of the guard bar, and at least one fastener configured to hold the hook block against the front face of the guard bar and to hold the back plate against the back face of the guard bar. The guard bar restraint is coupleable to the guard bar and configured to allow no more than a maximum predetermined amount of lateral movement by the guard bar.

20 Claims, 12 Drawing Sheets

(56) References Cited

U.S. PATENT DOCUMENTS

| | | | | |
|---|---|---|---|---|
| 7,467,748 | B2 * | 12/2008 | Weaver | B61F 9/00 238/17 |
| 7,472,837 | B2 * | 1/2009 | Weaver | B61F 9/00 238/17 |
| 8,474,730 | B2 | 7/2013 | Weaver et al. | |
| 2011/0204153 | A1 * | 8/2011 | Weaver | E01B 5/18 238/17 |

* cited by examiner

SYSTEM, METHOD, AND APPARATUS TO RESTRICT MOVEMENT OF RAILWAY GUARD BAR

TECHNICAL FIELD

The present disclosure relates to a railway guard rail assembly, and more particularly, to a guard bar restraint for restricting movement of a guard bar of the railway guard rail assembly.

BACKGROUND

Railway track system may be required to use guard rails for certain types of junctions. The guard rails can be coupled to guide rail support assemblies fixed to railway ties of the railway track system. In certain cases, the guard rails may be incorporated with a fully adjustable guard rails. Generally speaking, the guard rails can pull a set of wheels of a train such that the wheels follow a desired path, for instance, away from a V-point of the railway track system at a frog junction, so that the wheels of the train do not contact the V-point. However, guard rails can have a tendency of slipping and/or creeping in a longitudinal length direction due to train traffic. For example, a guard rail, if not reset to its original position, for instance, can slip and/or creep to a position where either the guard rail may no longer serve to prevent the wheels of the train from contacting the V-point of the frog junction, or to a position where the wheels of the train fail to even contact the guard rail, which may lead to a possible train wheel impediment.

U.S. Pat. No. 6,279,833, hereinafter referred as the '833 patent, describes a guide-rail assembly. The guide-rail assembly in the '833 patent includes an anchor plate having an upstanding flange with a transversely directed face, and formed below the face is at least one transversely through-going hole. A guide rail of the guide-rail assembly is provided above the hole and has a transversely directed outer face bearing transversely on the flange face and an inner face directed transversely oppositely. The '833 patent also describes that the guide-rail assembly includes a J-bolt having a bearing face directed transversely towards, and bearing on, the guide-rail inner face, and a shank extending through the hole below the guide rail. The guide-rail assembly also includes a nut threaded on the shank, to engage an outer surface of the plate, presses the J-bolt bearing face against the guide-rail inner face and clamps the guide rail against the anchor-plate face.

SUMMARY OF THE DISCLOSURE

In one aspect of the present disclosure, a railway guard rail assembly is provided. The railway guard rail assembly includes an adjustable guard rail having an inward-facing side, an outward-facing side opposite the inward-facing side, and a length defined by a first tapered end, a second tapered end opposite the first tapered end, and a non-tapered middle portion between the first tapered end and the second tapered end, a wear surface of the adjustable guard rail being provided on the outward-facing side of the adjustable guard rail and configured to contact wheels of a train. The railway guard rail assembly further includes a plurality of guide rail support assemblies coupled to the inward-facing side of the adjustable guard rail and the outward-facing side of the adjustable guard rail. The railway guard rail assembly further includes a first guard rail lateral restraint removably coupled to the inward-facing side of the adjustable guard rail and the outward-facing side of the adjustable guard rail at a first position of the non-tapered middle portion of the adjustable guard rail, between a first set of adjacent guide rail support assemblies of the plurality of guide rail support assemblies, a length of the first guard rail lateral restraint being greater than a width and a height of the first guard rail lateral restraint and defined by a first projection extending in a first direction, a second projection extending in a second direction opposite the first direction, and a first body extending between the first projection and the second projection, the length of the first guard rail lateral restraint being less than a distance between guide rail support assemblies of the first set of adjacent guide rail support assemblies. The railway guard assembly further includes a second guard rail lateral restraint removably coupled to the inward-facing side of the adjustable guard rail and the outward-facing side of the adjustable guard rail at a second position of the non-tapered middle portion of the guard rail, different from the first position of the non-tapered middle portion of the adjustable guard rail, between a second set of adjacent guide rail support assemblies of the plurality of guide rail support assemblies, a length of the second guard rail lateral restraint being greater than a width and a height of the second guard rail lateral restraint and defined by a third projection extending in the first direction, a fourth projection extending in the second direction opposite the first direction, and a second body extending between the third projection and the fourth projection, the length of the second guard rail lateral restraint being less than a distance between guide rail support assemblies of the second set of adjacent guide rail support assemblies. A first portion of the first guard rail lateral restraint extends under the adjustable guard rail. A second portion of the second guard rail lateral restraint extends under the adjustable guard rail.

In another aspect of the present disclosure, a method regarding a guard rail lateral restraint for restricting movement of a railway guard rail is provided. The method includes providing a retaining block to directly contact a first side of the railway guard rail such that a wear surface of the railway guard rail on the first side is exposed. The method further includes providing a plate to directly contact a second side of the railway guard rail opposite the first side. The method further includes providing at least one fastener to couple the retaining block to the plate such that the retaining block and the plate are removably coupled to the railway guard rail with the retaining block directly contacting the first side of the railway guard rail and the plate directly contacting the second side of the railway guard rail, without physically modifying the railway guard rail, to provide the guard rail lateral restraint for restricting movement of the railway guard rail. The guard rail lateral restraint is configured to move a predetermined maximum amount of lateral movement when the retaining block and the plate are removably coupled to the railway guard rail. The guard rail lateral restraint is configured to allow the predetermined maximum amount of lateral movement for the railway guard rail when the retaining block and the plate are removably coupled to the railway guard rail.

In yet another aspect of the present disclosure, a guard bar restraint for restricting movement of a guard bar in a single plane is provided. The guard bar restraint includes guard bar having a top surface, a bottom surface opposite the top surface, a back face and a front face opposite the back face, the front face having a first projection and a second projection spaced from the first projection, the first projection and the second projection projecting in a same direction, and the first projection projecting more than the second projection.

The guard bar restraint further includes a hook block directly coupled to the front face of the guard bar such that the top surface and the first projection of the guard bar are exposed and portions of the bottom surface and the second projection of the guard bar adjacent the hook block are unexposed. The guard bar restraint further includes a back plate configured to contact the back face of the guard bar. The guard bar restraint further includes at least one fastener configured to hold the hook block against the front face of the guard bar and to hold the back plate against the back face of the guard bar. The hook block has a body with a length greater than a width and a thickness of the body. The back plate has a body with a length greater than a width and a thickness of the body, the body of the back plate defining a first cut-out at a first end and a second cut-out at a second end opposite the first end in a length-wise direction of the body of the back plate.

Other features and aspects of this disclosure will be apparent from the following description and the accompanying drawings.

BRIEF DESCRIPTION OF THE DRAWINGS

The accompanying drawings, which are incorporated in and constitute a part of the specification, are illustrative of one or more embodiments and, together with the description, explain the embodiments. The accompanying drawings have not necessarily been drawn to scale. Further, any values or dimensions in the accompanying drawings are for illustration purposes only and may or may not represent actual or preferred values or dimensions. Where applicable, some or all select features may not be illustrated to assist in the description and understanding of underlying features.

DETAILED DESCRIPTION

Figure 1:
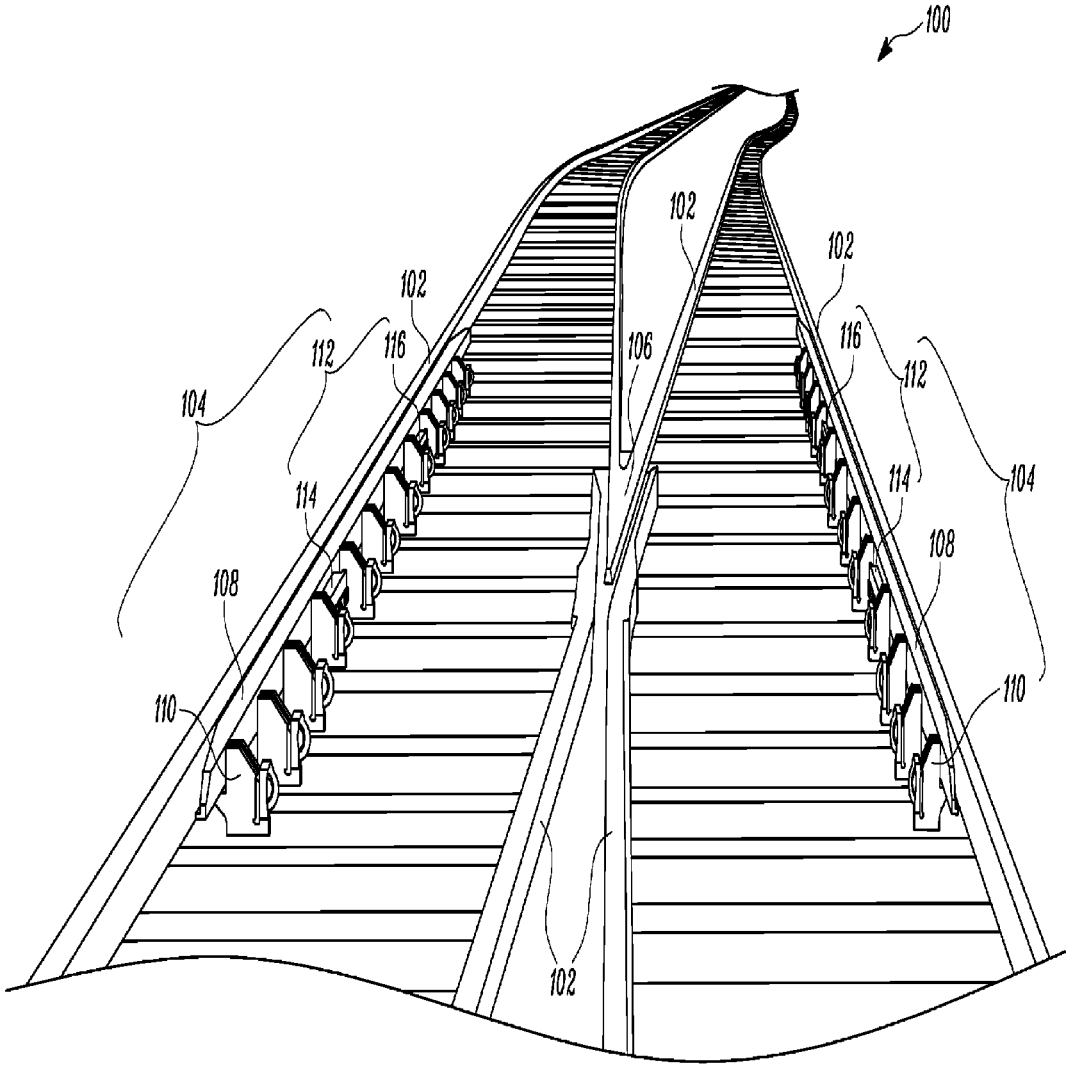
FIG. 1 is a perspective view of a portion of a railway track system having a plurality of railway guard rail assemblies according to one or more embodiments of the present disclosure.

The description set forth below in connection with the appended drawings is intended as a description of various embodiments of the described subject matter and is not necessarily intended to represent the only embodiment(s). In certain instances, the description includes specific details for the purpose of providing an understanding of the described subject matter. However, it will be apparent to those skilled in the art that embodiments may be practiced without these specific details. In some instances, well-known structures and components may be shown in block diagram form in order to avoid obscuring the concepts of the described subject matter. Wherever possible, the same reference numbers will be used throughout the drawings to refer to the same or the like parts.

Any reference in the specification to "one embodiment" or "an embodiment" means that a particular feature, structure, characteristic, operation, or function described in connection with an embodiment is included in at least one embodiment. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments, and it is intended that embodiments of the described subject matter can and do cover modifications and variations of the described embodiments.

It must also be noted that, as used in the specification, appended claims and abstract, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the described subject matter to any particular orientation or configuration. Furthermore, terms such as "first," "second," "third," etc. merely identify one of a number of portions, components, points of reference, operations and/or functions as described herein, and likewise do not necessarily limit embodiments of the described subject matter to any particular configuration or orientation.

Generally speaking, embodiments of the disclosed subject matter can involve mounting one or more lateral restraints on a guard rail or bar, without modifying the guard rail (e.g., no drilling or welding), to prevent the guard rail from moving laterally more than a predetermined amount. More specifically, each lateral restraint can be narrower than a spacing associated with a spacing between adjacent ties or a spacing between adjacent guide rail support assemblies of the track, so when the lateral restraint is coupled to the guard rail, the guard rail will be allowed to move the predetermined amount in either direction before the lateral restraint contacts a guide rail support assembly associated with one of the ties, thereby preventing the guard rail from moving more than the predetermined amount.

FIG. 1 illustrates a perspective view of a portion of a railway track system 100 according to one or more embodiments of the present disclosure. FIG. 1 illustrates a non-limiting example of the portion of the railway track system 100, as well as associated components that may be used in the railway track system 100. The railway track system 100 may be used in a railway system or railroads in which a locomotive and/or a train (not shown) travels along drive rails 102 arranged parallel to each other. The train may include locomotive(s), powered by diesel fuel and/or electricity, for driving the train, and may include one or more train cars for transporting the goods and/or the passengers. Further, each of the train cars may include at least two wheels on a left side and at least two wheels on a right side.

The railway track system 100 may include multiple pairs of the drive rails 102 and multiple railway guard rail assemblies 104 which may be similar in construction and operation. Thus, for explanatory purpose, only one of the railway guard rail assembly 104 is described in detail and is not meant to limit the scope of the present disclosure. Generally speaking, the railway guard rail assembly 104 is provided to ensure that the wheels of the train follow through a frog 106 so that the wheels of the train do not contact a particular part of the track, for instance, a V-point of the frog 106. Generally, for each frog 106, a pair of railway guard rail assemblies 104 may be provided. Each of the railway guard rail assemblies 104 can include at least one guard rail 108, which may be adjustable, disposed parallel to the drive rail 102 and opposite to the frog 106 of the railway track system 100. The term "guard rail" as used herein may be interchangeably used with term "guard bar" or "railway guard rail."

Figure 2:
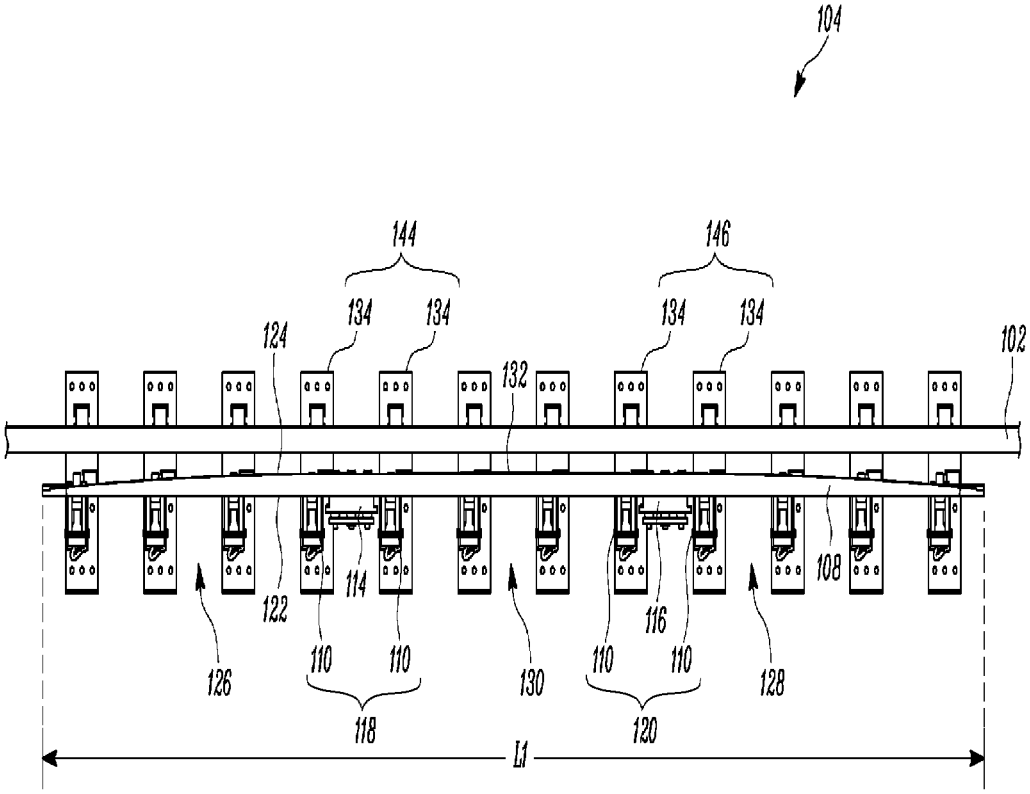
FIG. 2 is an overhead plan view of a railway guard rail assembly including a first guard rail lateral restraint and a second guard rail lateral restraint coupled to an adjustable guard rail, according to one or more embodiments of the present disclosure.
Figure 3:
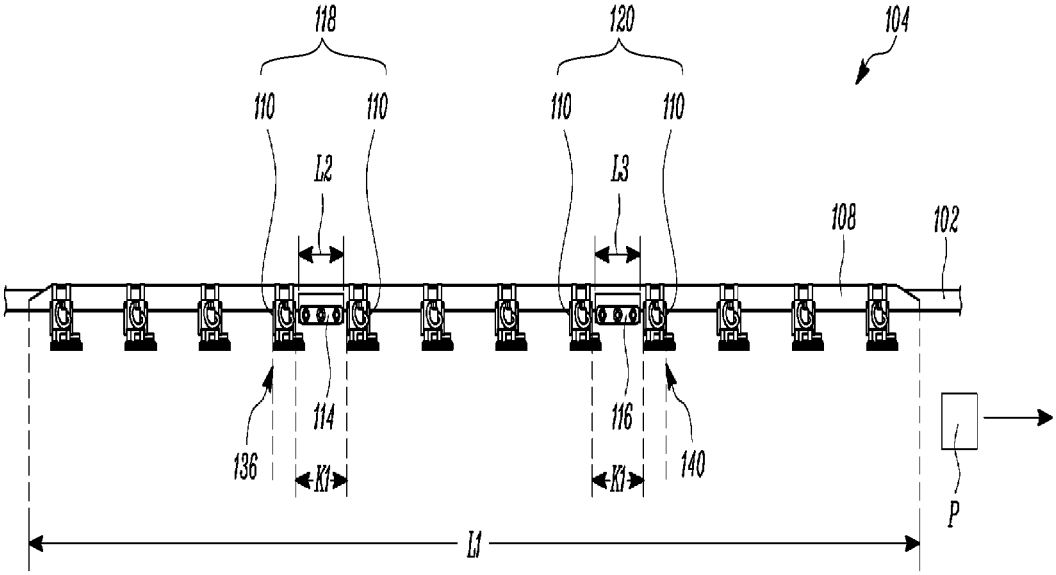
FIG. 3 is a side view of the railway guard rail assembly of FIG. 2.

The railway guard rail assembly 104 may further include a plurality of guide rail support assemblies 110 and one or more guard rail lateral restraints 112 (e.g., FIGS. 1-3 show each railway guard rail assembly 104 having two guard rail lateral restraints) disposed in a space between adjacent guide rail support assemblies 110 of the plurality of guide rail support assemblies 110.

FIG. 2 illustrates an overhead plan view of the railway guard rail assembly 104 that includes a first guard rail lateral restraint 114 and a second guard rail lateral restraint 116 coupled to the guard rail 108, according to one or more embodiments of the present disclosure. Thus, in the illustrated non-limiting example, each plurality of guard rail lateral restraints 112 includes the first guard rail lateral restraint 114 and the second guard rail lateral restraint 116. Also, the plurality of guide rail support assemblies 110 can include a first set of adjacent guide rail support assemblies 118 and a second set of adjacent guide rail support assemblies 120. The first guard rail lateral restraint 114 and the second guard rail lateral restraint 116 are configured to be disposed between the first set of adjacent guide rail support assemblies 118 and the second set of adjacent guide rail support assemblies 120, respectively, and coupled to the guard rail 108. The term "first guard rail lateral restraint" as used herein is interchangeably referred as "guard bar restraint" or "guard rail lateral restraint."

The guard rail 108 has an inward-facing side 122 and an outward-facing side 124 opposite to the inward-facing side 122. The guard rail 108 further includes a first tapered end 126, a second tapered end 128 opposite to the first tapered end 126, and a non-tapered middle portion 130 defined between the first tapered end 126 and the second tapered end 128. The guard rail 108 has a length "L1" defined between the first tapered end 126 and the second tapered end 128. The guard rail 108 further includes a wear surface 132 provided on the outward-facing side 124 of the guard rail 108. Generally speaking, the wear surface 132 is configured to contact with the wheels of the train. The guard rail 108 is supported by the plurality of guide rail support assemblies 110.

Each of the guide rail support assemblies 110 is configured to be fixedly coupled to a tie 134 of the railway track system 100. The ties 134 may be rectangular base support structures for the drive rails 102 of the railway track system 100. As illustrated, some ties 134 support a drive rail 102 and a guard rail 108 through a corresponding guide rail support assembly 110. The ties 134 may be laid perpendicular to the drive rails 102 and disposed, for instance, at an equal distance between them. The ties 134 may be made of concrete or wood. In the illustrated embodiment, the railway guard rail assembly 104 includes a first set of adjacent ties 144 coupled to respective ones of the first set of adjacent guide rail support assemblies 118. Also, a second set of adjacent ties 146 is coupled to respective ones of the second set of adjacent guide rail support assemblies 120. In an example, in an overhead plan view, the first guard rail lateral restraint 114 overlaps with at least one of the adjacent ties of the first set of adjacent ties 144. Additionally or optionally, the second guard rail lateral restraint 116 overlaps with at least one of the adjacent ties of the second set of adjacent ties 146 in the overhead plan view. Of course, in one or more embodiments, a guard rail lateral restraint 112 may overlap both adjacent ties, or, alternatively may overlap neither of the adjacent ties.

FIG. 3 illustrates a side view of the railway guard rail assembly 104 that includes the first guard rail lateral restraint 114 and the second guard rail lateral restraint 116 coupled with the guard rail 108. The plurality of guide rail support assemblies 110 may be disposed at a preset distance "K1" apart from each other along the length "L1" of the guard bar 108. Of course, in one or more embodiments, the preset distance K1 between adjacent guide rail support assemblies may be the same or different.

The first guard rail lateral restraint 114 is coupled, removably coupled, for instance, to the inward-facing side 122 and the outward-facing side 124 of the guard rail 108 at a first position 136 of the guard rail 108. The first position 136 can refer to a location on the guard rail 108 at the non-tapered middle portion 130 and not at the first tapered end 126. The first guard rail lateral restraint 114 is also disposed between adjacent guide rail support assemblies of the first set of adjacent guide rail support assemblies 118 of the plurality of guide rail support assemblies 110. In an embodiment, a length "L2" of the first guard rail lateral restraint 114 is greater than a width "W1" and a height "H1" of the first guard rail lateral restraint 114 (e.g., shown in greater detail in FIGS. 9 and 10). In an embodiment, the length "L2" of the first guard rail lateral restraint 114 is less than the preset distance "K1" defined between adjacent guide rail support assemblies of the first set of adjacent guide rail support assemblies 118. In an embodiment, a first portion 138 (shown in FIG. 8) of the first guard rail lateral restraint 114 extends under the guard rail 108.

The second guard rail lateral restraint 116 is coupled, removably coupled, for instance, to the inward-facing side 122 of the guard bar 108 and the outward-facing side 124 of the guard rail 108 at a second position 140 of the non-tapered middle portion 130 of the guard rail 108. The second guard rail lateral restraint 116 is further disposed between adjacent guide rail support assemblies of the second set of adjacent guide rail support assemblies 120 of the plurality of guide rail support assemblies 110. In an embodiment, a length "L3" of the second guard rail lateral restraint 116 is greater than a width and a height of the second guard rail lateral restraint 116. In the illustrated embodiment, the length "L3," the width, and the height of the second guard rail lateral restraint 116 may be equal to the length "L2," the width "W1," and the height "H1" of the first guard rail lateral restraint 114, respectively. In an embodiment, the length "L3" of the second guard rail lateral restraint 116 is less than the preset distance "K1" defined between adjacent guide rail support assemblies of the second set of adjacent guide rail support assemblies 120. In another embodiment, a second portion of the second guard rail lateral restraint 116, which may be identical to the first portion 138 of the first guard rail lateral restraint 114, can extend under the guard bar 108.

In an embodiment, the first guard rail lateral restraint 114 is configured to slide laterally, with the guard rail 108, no more than a first predetermined amount based on a first difference between the preset distance "K1" defined between adjacent guide rail support assemblies of the first set of adjacent guide rail support assemblies 118 and the length "L2" of the first guard rail lateral restraint 114. For example, in a case where the first guard rail lateral restraint 114 is centered in the middle of the preset distance "K1," the first guard rail lateral restraint 114 and the guard rail 108 may be allowed to move no more than half the first difference, defined by when the first guard rail lateral restraint 114 reaches one of the adjacent guide rail support assemblies of the first set of adjacent guide rail support assemblies 118.

Similarly, the second guard rail lateral restraint 116 is configured to slide laterally, with the guard rail 108, no more than a second predetermined amount based on a second difference between the preset distance "K1" defined between adjacent guide rail support assemblies of the second set of adjacent guide rail support assemblies 120 and the length "L3" of the second guard rail lateral restraint 116. For example, in a case where the second guard rail lateral restraint 116 is centered in the middle of the preset distance "K1," the second guard rail lateral restraint 116 and the guard rail 108 may be allowed to move no more than half the second difference, defined by when the second guard rail lateral restraint 116 reaches one of the adjacent guide rail support assemblies of the second set of adjacent guide rail support assemblies 120.

Of course, in one or more embodiments, the guard rail lateral restraints may be positioned different than as mentioned above. For example, each guard rail lateral restraint may be offset from the middle of preset distance "K1." Also, in a case where multiple guard rail lateral restraints are implemented to restrain a guard rail 108, one of the guard rail lateral restraints may be centered in the middle of the preset distance "K1" and another guard rail lateral restraint may be offset from the middle of the preset distance "K1." Alternatively, at least two guard rail lateral restraints may be offset from the middle of the preset distance "K1." Further, the offset may be the same or different in terms of amount and/or direction. In an exemplary embodiment, each of the first difference or distance and the second difference or distance can be one of 4.0 inches or less, 3.5 inches or less, 3.0 inches or less, 2.5 inches or less, 2.0 inches or less, 1.5 inches or less, 1.0 inches or less, 0.5 inches or less, 0.25 inches or less or 0.0 inches.

Figure 4:
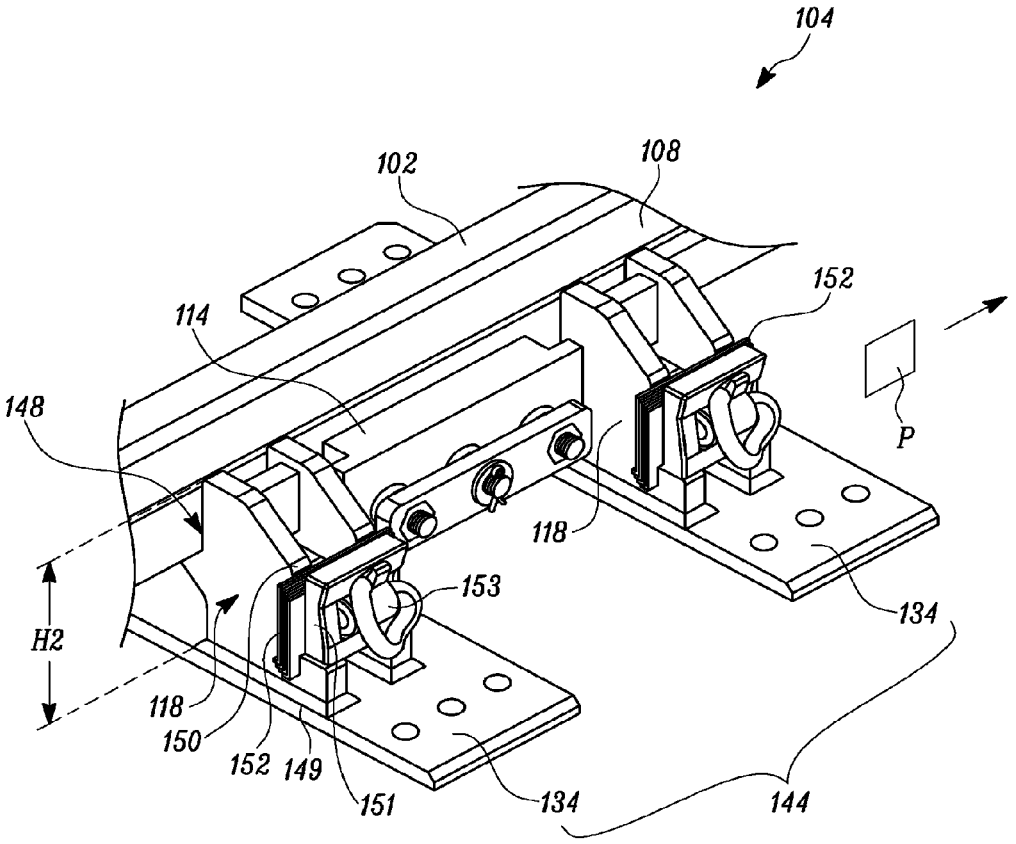
FIG. 4 is a perspective view of a portion of a railway guard rail assembly according to one or more embodiments of the present disclosure.

FIG. 4 illustrates a perspective view of a portion of the railway guard rail assembly 104 having the guard rail lateral restraint 114. It is to be understood that the first guard rail lateral restraint 114 and the second guard rail lateral restraint 116 may be identical. Hence, for explanation purpose, only the first guard rail lateral restraint 114 is described, which is not meant to limit the scope of the present disclosure. Further, the explanation for the first guard rail lateral restraint 114 may be equally applicable to the second guard rail lateral restraint 116.

Figure 11:
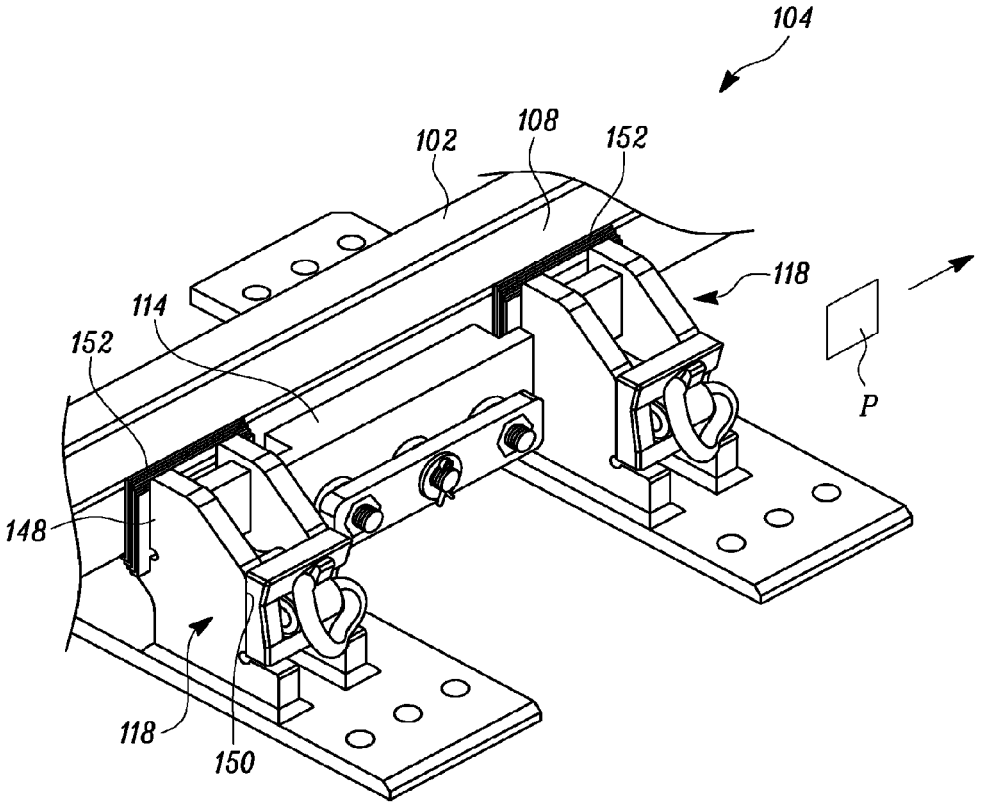
FIG. 11 is a perspective view of a portion of a railway guard rail assembly including the guard rail lateral restraint of FIG. 9 disposed between adjacent guide rail support assemblies with full adjustment of the adjustable guard rail, according to one or more embodiments of the present disclosure.
Figure 12:
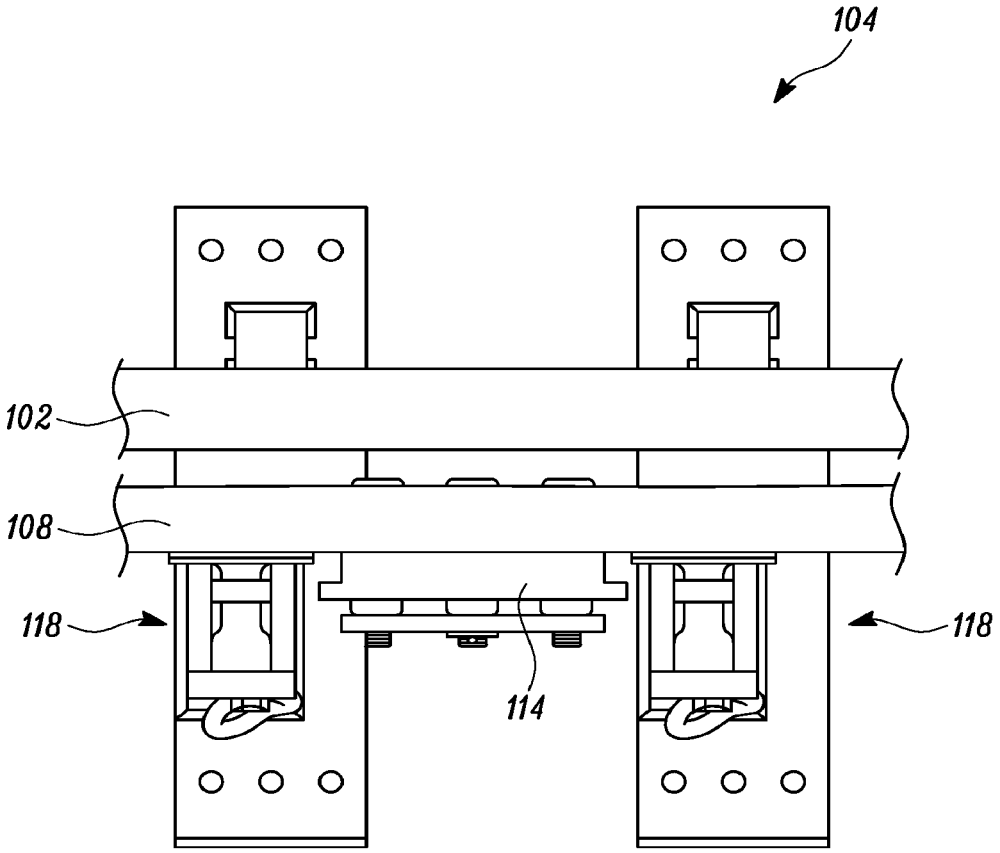
FIG. 12 is a plan view of the portion of the railway guard rail assembly of FIG. 11.
Figure 13:
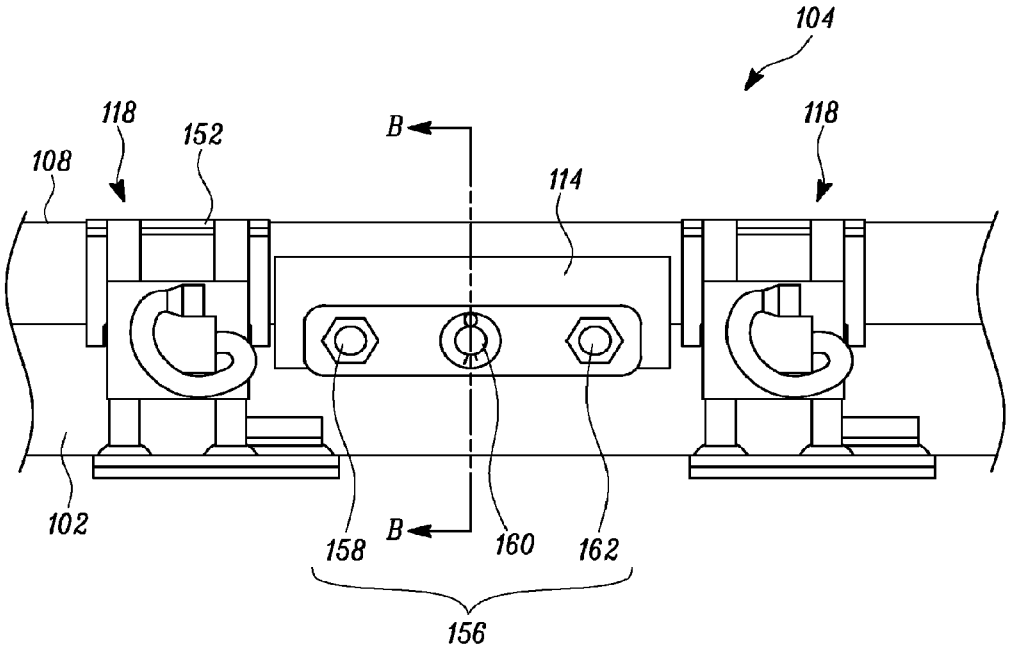
FIG. 13 is a side view of the portion of the railway guard rail assembly of FIG. 11.
Figure 14:
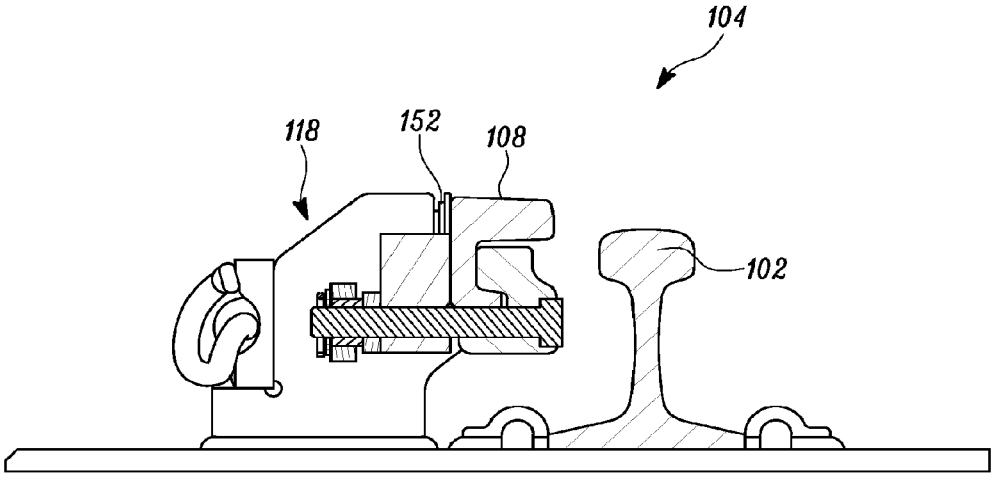
FIG. 14 is a sectional view of the railway guard rail assembly across line B-B of FIG. 13.

The guard rail lateral restraint 114 is configured to restrict movement of the guard bar 108 along a plane "P," in one or both directions. The guard rail lateral restraint 114 may be disposed between adjacent guide rail support assemblies of the first set of adjacent guide rail support assemblies 118. The first set of adjacent guide rail support assemblies 118 can include two guide rail support assemblies that may be coupled, removably coupled, for instance, to the first set of adjacent ties 144 on the railroad. Each adjacent guide rail support assembly of the first set of adjacent guide rail support assemblies 118 can include a front face 148 configured to contact with the guard rail 108 and a rear face 150 opposite to the front face 148. Each adjacent guide rail support assembly of the first set of adjacent guide rail support assemblies 118 further includes a bottom face 149 configured to be coupled to the first set of adjacent ties 144. Each adjacent guide rail support assembly of the first set of adjacent guide rail support assemblies 118 may also include a set of shims 152 disposed between the rear face 150 and a spring retainer 151, which, in association with a pin member 153, can enable coupling of each adjacent guide rail support assembly of the first set of adjacent guide rail support assemblies 118 with the guard rail 108. The set of shims 152 may be used for adjusting a gap between the guard rail 108 and the drive rail 102. The set of shims 152 may include a set of metallic plates of predefined thickness, for instance. Additionally or alternatively, as illustrated in FIG. 11, for instance, the set of shims 152 may be disposed between the front face 150 of the guide rail support assembly and the guard rail 108.

Figure 5:
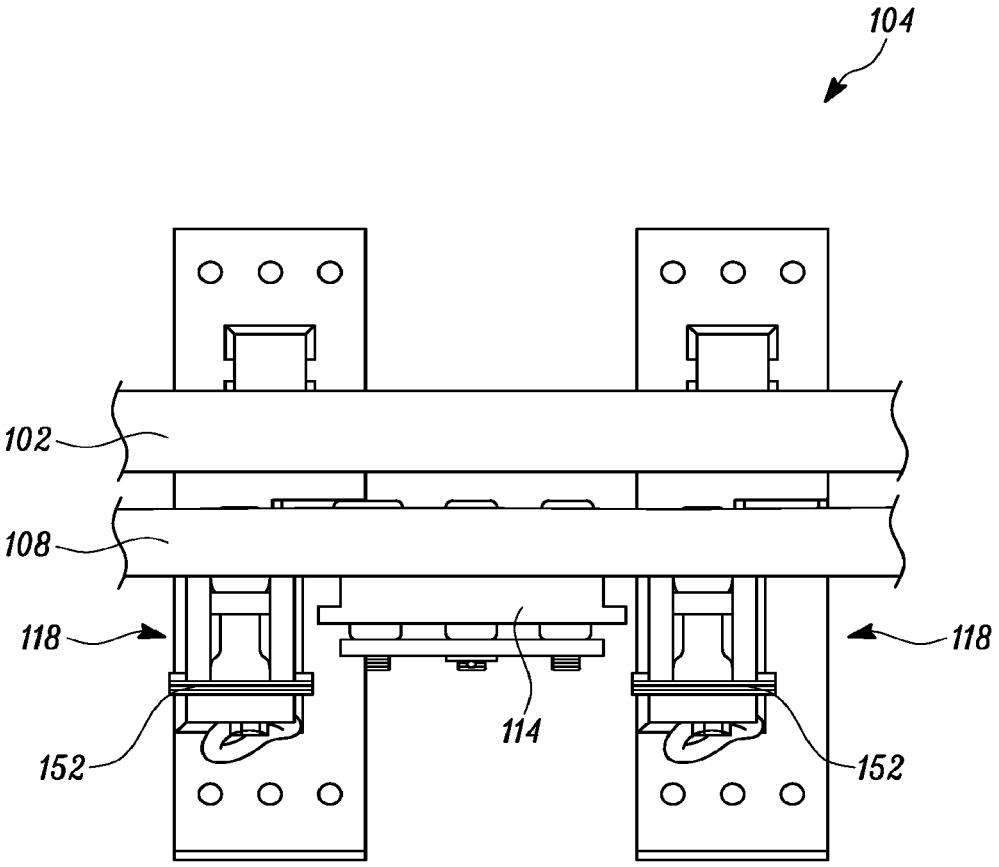
FIG. 5 is an overhead plan view of the portion of the railway guard rail assembly of FIG. 4.

FIG. 5 illustrates an overhead plan view of the portion of the railway guard rail assembly 104 of FIG. 4. In the illustrated embodiment, adjacent guide rail support assemblies of the first set of adjacent guide rail support assemblies 118 contact the guard rail 108. The guard rail lateral restraint 114 is coupled to the guard rail 108 between adjacent guide rail support assemblies of the first set of adjacent guide rail support assemblies 118. In the illustrated embodiment, the guard rail 108 is not adjusted with respect to the drive rail 102. Further, the sets of shims 152 are provided with the first set of adjacent guide rail support assemblies 118 for adjustment of the guard rail 108, for instance, during assembling of the first guard rail lateral restraint 114 with the guard rail 108.

Figure 6:
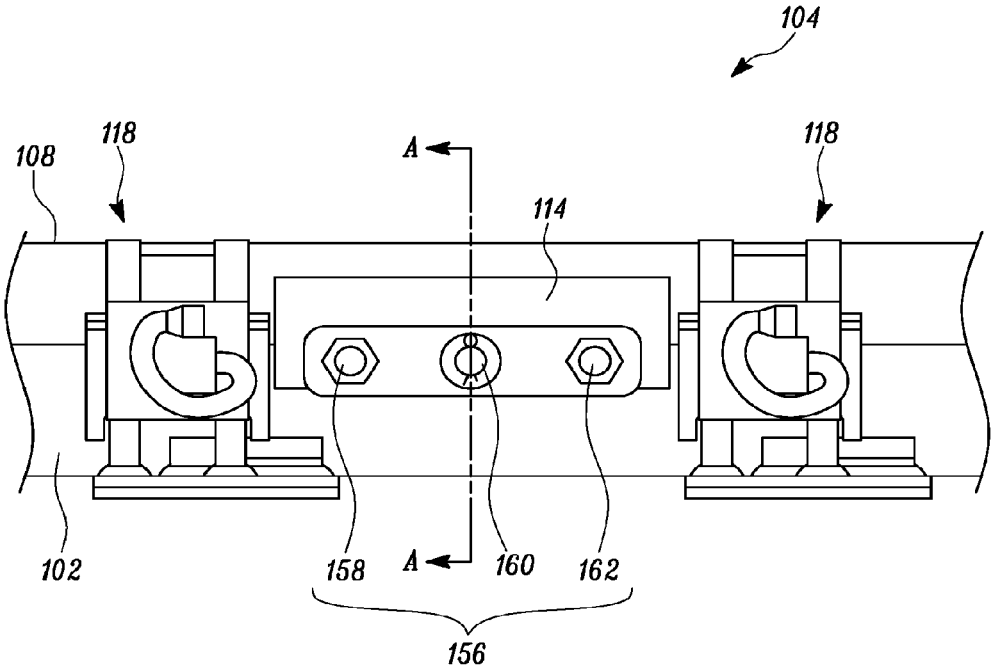
FIG. 6 is a side view of the portion of the railway guard rail assembly of FIG. 4.

FIG. 6 illustrates a side view of the portion of the railway guard rail assembly 104 of FIG. 4. The guard rail lateral restraint 114 of the railway guard rail assembly 104 can be coupled to the guard rail 108 using a plurality of fasteners 156, for instance. The plurality of fasteners 156 may include a first fastener 158, a second fastener 160, and a third fastener 162. The plurality of fasteners 156 may include, but not limited to, bolts, nuts or any other suitable fasteners. In the illustrated embodiment, the guard rail lateral restraint 114 is coupled with the guard rail 108 using three fasteners, the first fastener 158, the second fastener 160, and the third fastener 162. However, it can be understood that the guard rail lateral restraint 114 can be coupled to the guard rail 108 using a single fastener or multiple fasteners, which may be based on the length "L2" of the guard rail lateral restraint 114 and/or required fastening force.

In the illustrated embodiment, the second fastener 160, which can be coupled at a length-wise center of the guard rail lateral restraint 114, may be a fixed fastener, such as the second fastener 160, which can maintain the rail guard lateral restraint 114 in an assembled state with the guard rail 108 during operation. In another embodiment, the first fastener 158 and the third fastener 162 may be provided adjacent to the second fastener 160 and configured to be removably coupled to the guard rail lateral restraint 114. The second fastener 160 can further include a bolt, which may be slightly longer that the first fastener 158 and the third fastener 162.

Figure 7:
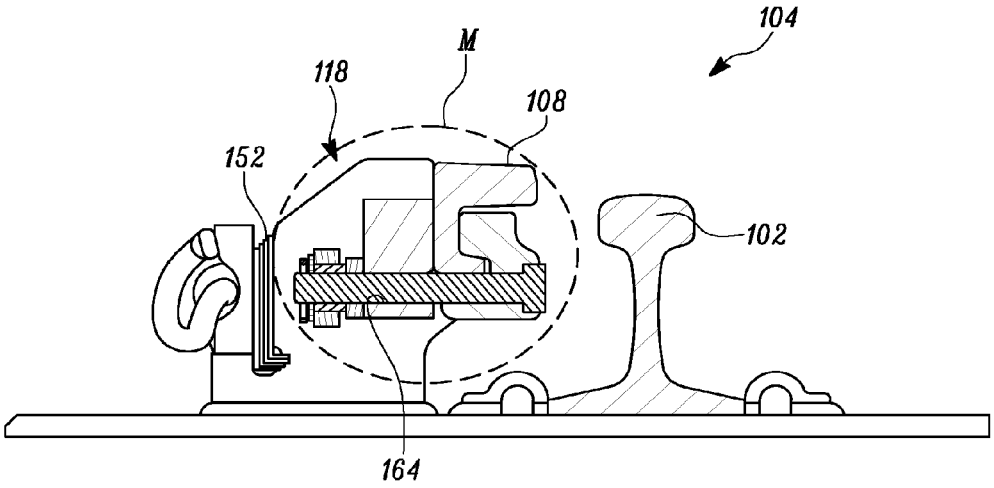
FIG. 7 is a sectional view of the railway guard rail assembly across line A-A of FIG. 6.

FIG. 7 illustrates a sectional view of the railway guard rail assembly 104 across line A-A of FIG. 6. Further, FIG. 8 illustrates a magnified view of a portion "M" of the guard rail lateral restraint 114 of FIG. 7.

Figure 8:
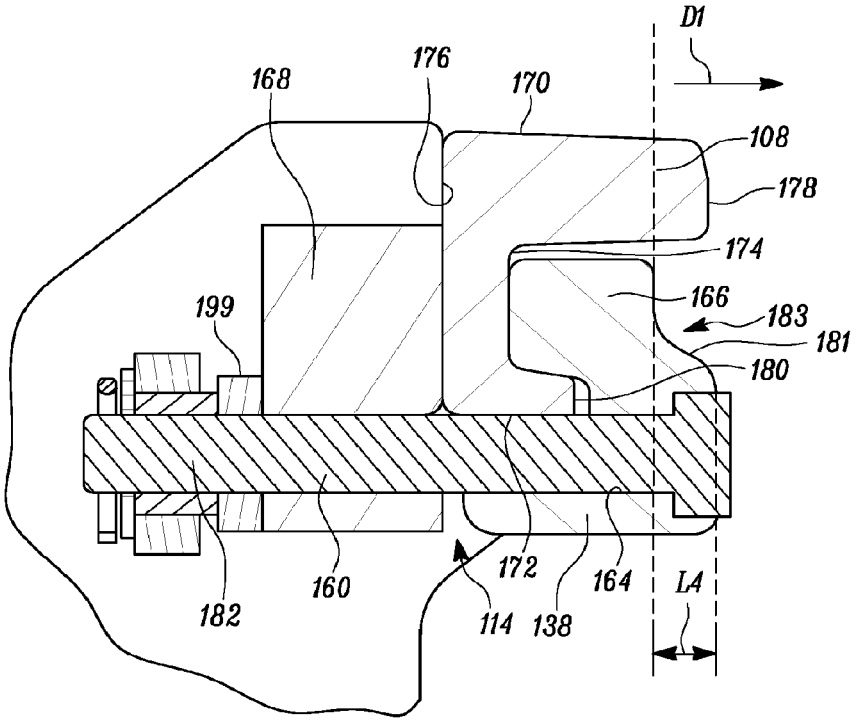
FIG. 8 is a magnified view of the portion "M" of FIG. 7.

Referring to FIG. 7 and FIG. 8, the guard rail lateral restraint 114 is configured to hold the guard rail 108 between a hook block 166 and a back plate 168 using the plurality of fasteners 156. The guard rail 108 includes a top surface 170, a bottom surface 172 opposite to the top surface 170, a front face 174 and a back face 176 opposite to the front face 174. The front face 174 may include a first projection 178 and a second projection 180 spaced from the first projection 178. The first projection 178 and the second projection 180 can project in a direction "D1." In an embodiment, the first projection 178 can project in the direction "D1" more than the second projection 180. The hook block 166 of the guard rail lateral restraint 114 can be directly coupled to the front face 174 of the guard rail 108, for instance, between the first projection 178 and the second projection 180, such that the top surface 170 and the first projection 178 of the guard rail 108 are exposed and portions of the bottom surface 172 and the second projection 180 of the guard rail 108 adjacent to the hook block 166 are unexposed. The hook block 166 further includes the first portion 138 disposed below the second projection 180 of the guard rail 108.

In an embodiment, a front surface 181 of the hook block 166 facing the guard rail 108 may be provided with a cut-out portion, a third cut-out 183. The third cut-out 183 may be provided with a length "L4" (i.e., a depth) such that the front surface 181 of the hook block 166 is not a wear surface, as the recessed portion of the third cut-out 183 of the front surface 181 does not contact the wheels of the train (or it is not intended to contact the wheels of the train).

In an embodiment, the back plate 168 of the guard rail lateral restraint 114 is configured to contact the back face 176 of the guard rail 108, for instance, to directly contact the back face 176 of the guard rail 108. The plurality of fasteners 156 is configured to extend through the back plate 168 and the hook block 166 to hold the hook block 166 against the front face 174 of the guard rail 108 and to hold the back plate 168 against the back face 176 of the guard rail 108, for instance, such that no portion of the hook block 166 contacts the back plate 168. In an embodiment, the hook block 166 is provided with multiple recesses 164 to receive a first end 182 of the plurality of fasteners 156. Further, a second end of each of the plurality of fasteners 156 opposite the first end 182 may be seated in a recess of the hook block 166.

Figure 9:
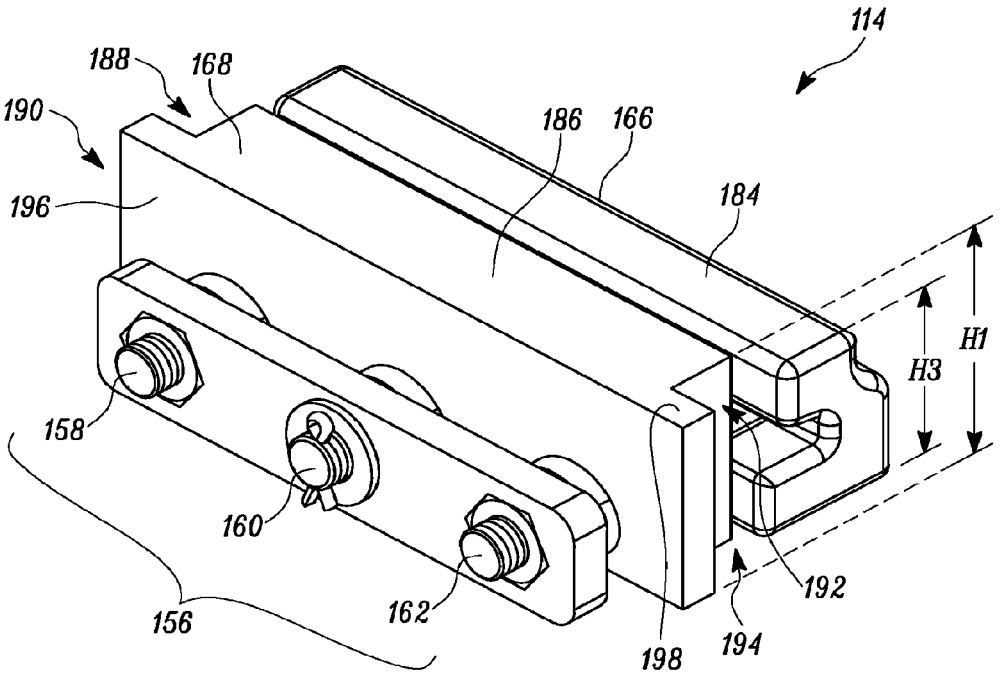
FIG. 9 is a perspective view of a guard rail lateral restraint according to one or more embodiments of the present disclosure.

FIG. 9 illustrates a perspective view of the guard rail lateral restraint 114. The guard rail lateral restraint 114 can include the hook block 166 having a length "L5" (shown in FIG. 10), which may be greater than a width "W2" (shown in FIG. 10) and/or a height "H3" (shown in FIG. 10) of a body 184 of the hook block 166. The back plate 168 has a body 186 with the length "L2" (shown in FIG. 10), which may be greater than a width "W3" (shown in FIG. 10) and/or a height "H1." The height "H1" of the back plate 168 may be considered as the height "H1" of the guard rail lateral restraint 114. In an embodiment, the length "L2" of the back plate 168 can be greater than the length "L5" of the hook block 166.

The body 186 of the back plate 168 can include a first cut-out 188 at a first end 190 and a second cut-out 192 at a second end 194. The second end 194 is located opposite the first end 190 in a length-wise direction of the body 186 of the back plate 168. Further, the body 186 of the back plate 168 can include a first projection 196 adjacent the first cut-out 188 and a second projection 198 adjacent the second cut-out 192.

In an embodiment, the height "H1" of the first guard rail lateral restraint 114 is less than respective heights "H2" (shown in FIG. 4) of adjacent guide rail support assemblies of the first set of adjacent guide rail support assemblies 118, and a height of the second guard rail lateral restraint 116, which may be equal to the height "H1" of the first guard rail lateral restraint 114 is less than respective heights of adjacent guide rail support assemblies of the second set of adjacent guide rail support assemblies 120.

Figure 10:
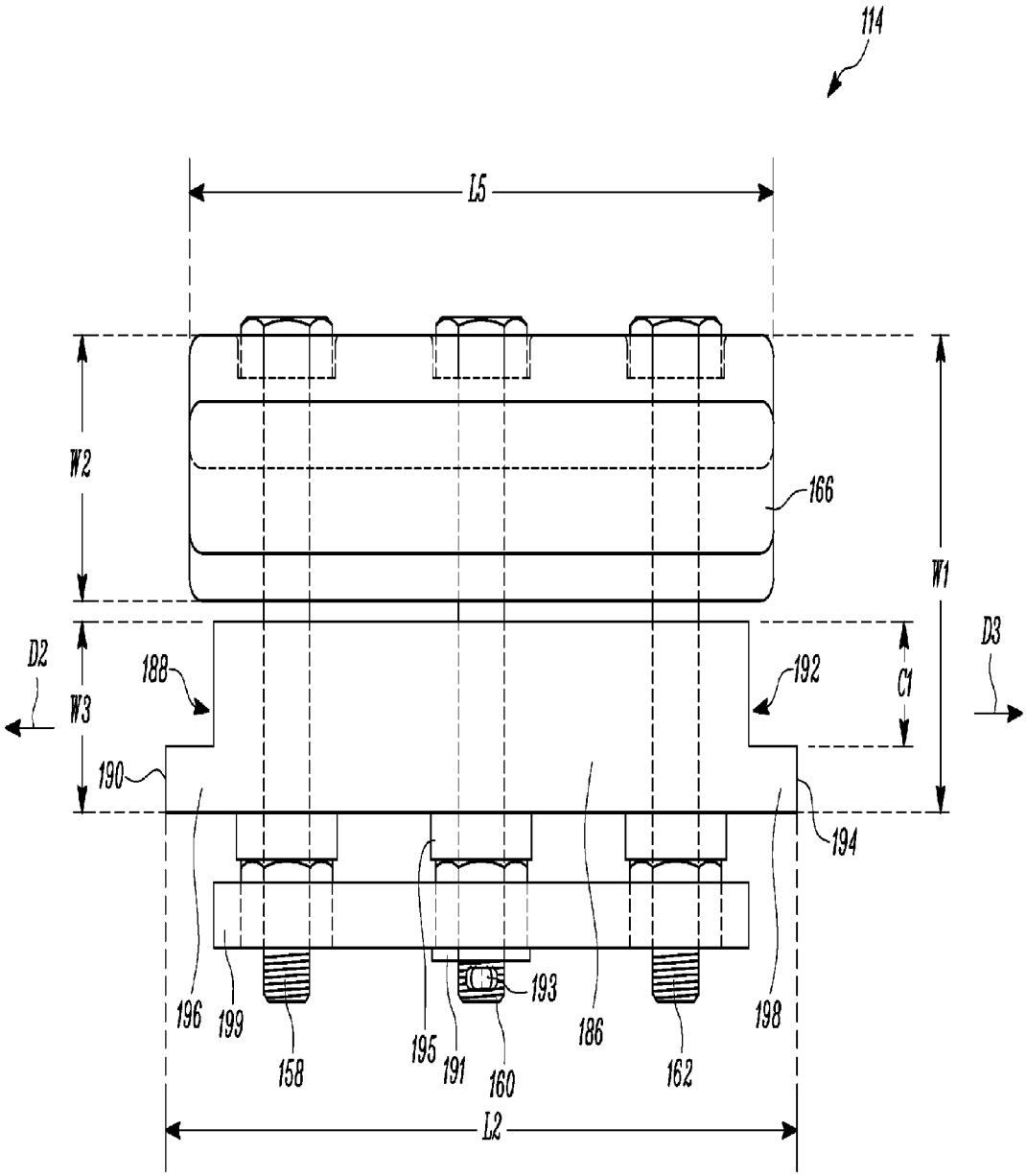
FIG. 10 is an overhead plan view of the guard rail lateral restraint of FIG. 9.

FIG. 10 illustrates an overhead plan view of the guard rail lateral restraint 114 of FIG. 9. The first projection 196 of the back plate 168 can extend in a first direction "D2," and the second projection 198 of the back plate 168 can extend in a second direction "D3," which may be opposite the first direction "D2." The body 186 of the back plate 168 extends between the first projection 196 and the second projection 198 (and between the first cut-out 188 and the second cut-out 192). The first projection 196 and the second projection 198 of the back plate 168 are configured to restrict movement of the guard rail 108 along the plane "P" (shown in FIGS. 3 and 4). Similarly, the back plate of the second guard rail lateral restraint 116 can be provided with a third projection, which extends in the first direction "D2," and can be identical to the first projection 196 of the back plate 168 of the first guard rail lateral restraint 114. The back plate of the second guard rail lateral restraint 116 can be provided with, a fourth projection, which extends in the second direction "D3," and can be identical to the second projection 198 of the back plate 168 of the first guard rail lateral restraint 114. The back plate of the second guard rail lateral restraint 116 can further include a second body, which can extend between the third projection and the fourth projection (and respective adjacent cut-outs).

The guard rail lateral restraint 114 may further includes a head lock 199 configured to lock the plurality of fasteners 156. Thus, the head lock 199 is configured to serve as an auxiliary support member for coupling the back plate 168 to the hook block 166 when the guard rail 108 is disposed in between the back plate 168 and the hook block 166. In an embodiment, the hook block 166, the back plate 168, and the plurality of fasteners 156 can be made from a metal or an alloy. Optionally, a maximum length of the back plate 168 can be greater than respective maximum lengths of the hook block 166 and the head lock 199. In an embodiment, the second fastener 160 can have a bolt which is surmounted by a flat washer 191 and a cotter pin 193 to hold the head lock 199. Optionally, a spring washer 195 can be inserted over the bolts between the back plate 168 and the head lock 199.

In an embodiment, the first cut-out 188 and the second cut-out 192 of the back plate 168 can have a depth "C1" that faces towards the hook block 166 when assembled with the hook block 166. The depth "C1" can allow the back plate 168 to fit over the set of shims 152 of the guard rail support assemblies 110 when the first guard rail lateral restraint 114 moves with the guard rail 108 so the first projection 196 and the second projection 198 of the back plate 168, not the body 186 of the back plate 168, can contact a corresponding one of the guide rail support assemblies 110 and prevent the guard rail 108 from moving any further, for instance, such as based on FIG. 11.

FIGS. 11 to 14 illustrates various views of a portion of the railway guard rail assembly 104 having the guard rail lateral restraint 114 and the guard rail 108 in a fully adjusted condition with respect to the drive rail 102, according to one or more embodiments of the present disclosure. The first guard rail lateral restraint 114 is disposed between the first set of adjacent guide rail support assemblies 118 and is adapted to restrict movement of the guard rail 108 along the plane "P."

Each of the first set of adjacent guide rail support assemblies 118 includes the front face 148 and the rear face 150 opposite to the front face 148. Further, each of the first set of adjacent guide rail support assemblies 118 can include the set of shims 152 between the front face 148 and the guard rail 108 to adjust a gap between the guard rail 108 and the drive rail 102. The set of shims 152 (or a subset thereof) may be removed and/or placed between the front face 148 of the first set of adjacent guide rail support assemblies 118 and the guard rail 108 to adjust the gap between the guard rail 108 and the drive rail 102.

INDUSTRIAL APPLICABILITY

The present disclosure relates to the railway guard rail assembly 104, which may have one or the plurality of guard rail lateral restraints 112, and a method 200 thereof, for providing one or more of the guard rail lateral restraints 112 that are configured to restrict movement of the guard rail 108 with respect to the drive rail 102. Each of the guard rail lateral restraints 112 can include a hook block and back plate, such as the hook block 166 and the back plate 168, that can be coupled, for instance, removably, to the guard rail 108 using one or more fasteners, such as the plurality of fasteners 156. The hook block 166 and the back plate 168 can be individual components and can be mounted on the guard rail 108 without physically modifying the guard rail 108, hence the guard rail lateral restraints 112 may be coupled to the guard rail 108 without disturbing other components of the railway guard rail assembly 104. Thus, the guard rail lateral restraints 112 according to embodiments of the present embodiment can be used to prevent any lateral movement of the guard rail 108 beyond a predetermined maximum amount without any modification, such as welding or drilling, to the guard rail 108. The hook block 166, the back plate 168, and the guard rail 108 may be referred to herein as "the retaining block," "the plate," and "the railway guard rail," respectively.

Figure 15:
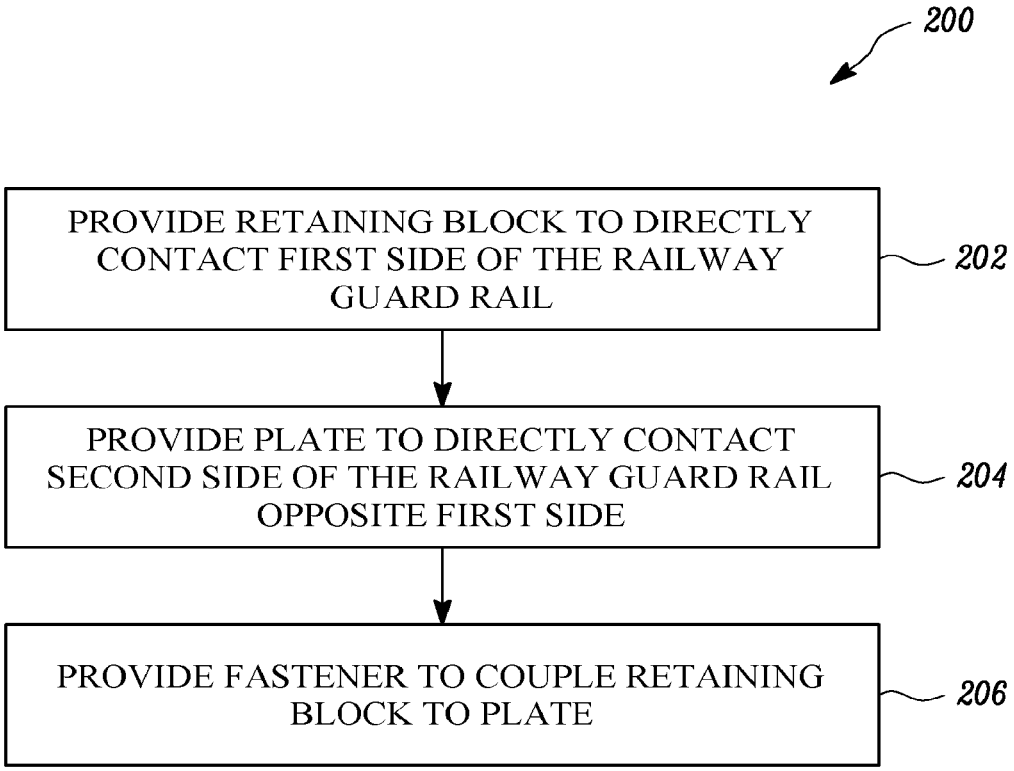
FIG. 15 is a flowchart of a method for restricting movement of an adjustable guard rail according to one or more embodiments of the present disclosure.

FIG. 15 illustrates a flow chart of a method 200 for restricting movement of a railway guard rail, such as guard rail 108, according to one or more embodiments of the present disclosure.

At operation 202, the method 200 can include providing a retaining block, such as hook block 166, to contact (e.g., directly) a first side of the railway guard rail 108. The retaining block can be provided in such a manner that the wear surface 132 of the railway guard rail 108 is exposed.

At operation 204, the method can include providing a plate, such as back plate 168 in contact with a second side of the guard rail 108. The first side and the second side of the guard rail 108 may refer to "the front face 174" and "the back face 176" of the railway guard rail 108, respectively, as described earlier. Thus the retaining block and the plate can be disposed at the outward-facing side 124 and the inward-facing side 122 of the railway guard rail 108, respectively.

At operation 206, the method 200 can include providing the plurality of fasteners 156 to couple the retaining block to the plate such that the retaining block and the plate are removably coupled to the guard rail 108. Further, the retaining block 166 can directly contact the front face 174 of the railway guard rail 108, and the plate 168 can directly contact the back face 176 of the railway guard rail 108 to provide a guard rail lateral restraint, such as guard rail lateral restraint 112, to restrict movement of the guard rail 108. Attachment of the guard rail lateral restraint can be without physically modifying the guard rail 108.

In one embodiment, each guard rail lateral restraint 112 can be allowed to move by the predetermined maximum amount of lateral movement when the retaining block and the plate are removably coupled to the guard rail 108. Further, each guard rail lateral restraint 112 can allow the predetermined maximum amount of lateral movement of the guard rail 108 when the retaining block and the plate are removably coupled to the guard rail 108. The predetermined maximum amount of lateral movement can be either in the first direction "D2" corresponding to the length-wise direction of the guard rail 108 or the second direction "D3" opposite the first direction "D2." Further, the predetermined maximum amount of the lateral movement may be defined based on a space between an end portion of the plate and an adjacent guide rail support assembly 110. The end portions of the plate can refer to "the first projection 196" and "the second projection 198" of the back plate 168, for instance.

In one example, the predetermined maximum amount of the lateral movement of the guard rail 108 can be about 1 inch. In another example, the predetermined maximum amount of the lateral movement of the guard rail 108 can be zero, (i.e., no space on one or both sides of the guard rail lateral restraint 114). In yet another example, the predetermined maximum amount of the lateral movement of the guard rail 108 can be ¼ inch on one or both sides, ½ inch on one or both sides, 1 inch on one or both sides, 1.5 inches on one or both sides, 2 inches on one or both sides, 3 inches on one or both sides, and 4 inches on one or both sides. In yet another example, the predetermined maximum amount of the lateral movement of the railway guard rail 108 can be up to 12 inches or 18 inches in one or both of the first direction "D2" and the second direction "D3."

The method 200 can also include removably coupling the retaining block and the plate to the guard rail 108 such that the retaining block contacts (e.g., directly) the front face 174 of the railway guard rail 108 and the plate contacts (e.g., directly) the back face 176 of the guard rail 108, without physically modifying the guard rail 108, to provide the guard rail lateral restraint 112 for restricting movement of the guard rail 108 by the predetermined maximum amount of lateral movement.

Thus, the first and second guard rail lateral restraints 114, 116 can be mounted on the guard rail 108 without physically modifying the guard rail 108, to prevent the movement of the guard rail 108 by the predetermined amount of lateral movement in the first direction "D2" and the second direction "D3."

In one embodiment, coupling of the first and second guard rail lateral restraints 114, 116 to the guard rail 108 can increase clamping area and clamping force beyond the clamping ability of the plurality of guide rail support assemblies 110. Once the first and second guard rail lateral restraints 114, 116 are removably clamped to the guard rail 108, the guard rail 108 is able to move by the predetermined maximum amount, but further movement of the railway guard rail 108 past this amount is restricted due to contact of the end portions 196, 198 of the back plate 168 of each of the first and second guard rail lateral restraints 114, 116 with the respective guide rail support assemblies 110.

Accordingly, one or more of the first and second guard bar lateral restraints 114, 116 can be applied to the guard rail 108 any time in the railway guard rail assembly life. Further, the first and second guard bar lateral restraints 114, 116 can be applied to the guard rail 108 at a factory or as a retrofit in the field. The predetermined maximum amount of lateral movement of the guard rail 108 may be adjusted based on the space between two adjacent ties 134 or two adjacent guide rail support assemblies 110, the length "L2" of the first and second guard bar lateral restraints 114, 116, and positioning of the first and second guard bar lateral restraints 114, 116 between two adjacent ties 134 and the two adjacent guide rail support assemblies 110. Further, the first and second guard bar lateral restraints 114, 116 can be used with different railway guard rails having different sizes and shapes. Further, the first and second guard bar restraints 114, 116 have flexibility in assembling in between the ties 134 and the two adjacent guide rail support assemblies 110, and hence, the first and second guard bar restraints 114, 116 do not have to be middle-aligned between the space of two adjacent ties 134 or two adjacent guide rail support assemblies 110.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A railway guard rail assembly comprising:

an adjustable guard rail having an inward-facing side, an outward-facing side opposite the inward-facing side, and a length defined by a first tapered end, a second tapered end opposite the first tapered end, and a non-tapered middle portion between the first tapered end and the second tapered end, a wear surface of the adjustable guard rail being provided on the outward-facing side of the adjustable guard rail and configured to contact wheels of a train;

a plurality of guide rail support assemblies coupled to the inward-facing side of the adjustable guard rail and the outward-facing side of the adjustable guard rail;

a first guard rail lateral restraint removably coupled to the inward-facing side of the adjustable guard rail and the outward-facing side of the adjustable guard rail at a first position of the non-tapered middle portion of the adjustable guard rail, between a first set of adjacent guide rail support assemblies of the plurality of guide rail support assemblies, a length of the first guard rail lateral restraint being greater than a width and a height of the first guard rail lateral restraint and defined by a first projection extending in a first direction, a second projection extending in a second direction opposite the first direction, and a first body extending between the first projection and the second projection, the length of the first guard rail lateral restraint being less than a distance between guide rail support assemblies of the first set of adjacent guide rail support assemblies; and a second guard rail lateral restraint removably coupled to the inward-facing side of the adjustable guard rail and the outward-facing side of the adjustable guard rail at a second position of the non-tapered middle portion of the guard rail, different from the first position of the non-tapered middle portion of the adjustable guard rail, between a second set of adjacent guide rail support assemblies of the plurality of guide rail support assemblies, a length of the second guard rail lateral restraint being greater than a width and a height of the second guard rail lateral restraint and defined by a third projection extending in the first direction, a fourth projection extending in the second direction opposite the first direction, and a second body extending between the third projection and the fourth projection, the length of the second guard rail lateral restraint being less than a distance between guide rail support assemblies of the second set of adjacent guide rail support assemblies, wherein a first portion of the first guard rail lateral restraint extends under the adjustable guard rail, and wherein a second portion of the second guard rail lateral restraint extends under the adjustable guard rail.

2. The railway guard rail assembly of claim 1, wherein each of the first guard rail lateral restraint and the second guard rail lateral restraint includes:

a hook block directly contacting the outward-facing side of the adjustable guard rail such that the wear surface of the adjustable guard rail is exposed, a back plate directly contacting the inward-facing side of the adjustable guard rail, and at least one fastener coupling the hook block to the back plate.

3. The railway guard rail assembly of claim 1, wherein the first guard rail lateral restraint is configured to slide laterally, with the adjustable guard rail, no more than a first predetermined amount defined by a first difference between the distance between the guide rail support assemblies of the first set of adjacent guide rail support assemblies and the length of the first guard rail lateral restraint, and wherein the second guard rail lateral restraint is configured to slide laterally, with the adjustable guard rail, no more than a second predetermined amount defined by a second difference between the distance between the guide rail support assemblies of the second set of adjacent guide rail support assemblies and the length of the second guard rail lateral restraint.

4. The railway guard rail assembly of claim 3, wherein each of the first difference and the second difference is one of 4.0 inches or less, 3.5 inches or less, 3.0 inches or less, 2.5 inches or less, 2.0 inches or less, 1.5 inches or less, 1.0 inches or less, 0.5 inches or less, 0.25 inches or less, or 0.0 inches.

5. The railway guard rail assembly of claim 1, wherein the height of the first guard rail lateral restraint is less than respective heights of the guide rail support assemblies of the first set of adjacent guide rail support assemblies, and wherein the height of the second guard rail lateral restraint is less than respective heights of the guide rail support assemblies of the second set of adjacent guide rail support assemblies.

6. The railway guard rail assembly of claim 1, further comprising:

a first set of adjacent ties coupled to respective ones of the guide rail support assemblies of the first set of adjacent guide rail support assemblies; and a second set of adjacent ties coupled to corresponding ones of the guide rail support assemblies of the second set of adjacent guide rail support assemblies, wherein, in a plan view, the first guard rail lateral restraint overlaps at least one of the ties of the first set of adjacent ties and/or the second guard rail lateral restraint overlaps at least one of the ties of the second set of adjacent ties.

7. A method regarding a guard rail lateral restraint for restricting movement of a railway guard rail, the method comprising:

providing a retaining block to directly contact a first side of the railway guard rail such that a wear surface of the railway guard rail on the first side is exposed;

providing a plate to directly contact a second side of the railway guard rail opposite the first side; and providing at least one fastener to couple the retaining block to the plate such that the retaining block and the plate are removably coupled to the railway guard rail with the retaining block directly contacting the first side of the railway guard rail and the plate directly contacting the second side of the railway guard rail, without physically modifying the railway guard rail, to provide the guard rail lateral restraint for restricting movement of the railway guard rail, wherein the guard rail lateral restraint is configured to move a predetermined maximum amount of lateral movement when the retaining block and the plate are removably coupled to the railway guard rail, and wherein the guard rail lateral restraint is configured to allow the predetermined maximum amount of lateral movement for the railway guard rail when the retaining block and the plate are removably coupled to the railway guard rail.

8. The method of claim 7, further comprising removably coupling the retaining block and the plate to the railway guard rail with the retaining block directly contacting the first side of the railway guard rail and the plate directly contacting the second side of the railway guard rail, without physically modifying the railway guard rail, to provide the guard rail lateral restraint for restricting movement of the railway guard rail by the predetermined maximum amount of lateral movement.

9. The method of claim 7, wherein the providing the at least one fastener includes providing a plurality of the fasteners to couple the retaining block to the plate such that the retaining block and the plate are removably coupled to the railway guard rail with the retaining block directly contacting the first side of the railway guard rail and the plate directly contacting the second side of the railway guard rail, without physically modifying the railway guard rail, to provide the guard rail lateral restraint for restricting movement of the railway guard rail.

10. The method of claim 7, wherein the predetermined maximum amount of lateral movement is either in a first direction corresponding a length-wise direction of the railway guard rail or a second direction opposite the first direction.

11. The method of claim 7, wherein the predetermined maximum amount of lateral movement is based on a space between an end portion of the plate and an adjacent guide rail support assembly.

12. A guard bar restraint for restricting movement of a guard bar in a single plane, the guard bar having a top surface, a bottom surface opposite the top surface, a back face and a front face opposite the back face, the front face having a first projection and a second projection spaced from the first projection, the first projection and the second projection projecting in a same direction, and the first projection projecting more than the second projection, the guard bar restraint comprising:

a hook block directly coupleable to the front face of the guard bar such that the top surface and the first projection of the guard bar are exposed and portions of the bottom surface and the second projection of the guard bar adjacent the hook block are unexposed;

a back plate configured to contact the back face of the guard bar; and at least one fastener configured to hold the hook block against the front face of the guard bar and to hold the back plate against the back face of the guard bar, wherein the hook block has a body with a length greater than a width and a thickness of the body, and wherein the back plate has a body with a length greater than a width and a thickness of the body, the body of the back plate defining a first cut-out at a first end and a second cut-out at a second end opposite the first end in a length-wise direction of the body of the back plate.

13. The guard bar restraint of claim 12, wherein no portion of the hook block contacts the back plate.

14. The guard bar restraint of claim 12, wherein the length of the hook block is greater than the length of the back plate.

15. The guard bar restraint of claim 12, wherein the at least one fastener extends through the back plate and the hook block.

16. The guard bar restraint of claim 12, wherein the body of the back plate includes a first projection adjacent the first cut-out defined by the body of the back plate, and a second projection adjacent the second cut-out defined by the body of the back plate, and wherein the guard bar restraint is configured to restrict movement of the guard bar in the single plane using the first projection and the second projection.

17. The guard bar restraint of claim 12, further comprising a head lock coupled to the hook block by the at least one fastener.

18. The guard bar restraint of claim 12, wherein the at least one fastener includes a plurality of fasteners configured to hold the hook block against the front face of the guard bar and to hold the back plate against the back face of the guard bar.

19. The guard bar restraint of claim 12, wherein one or more of the hook block, the back plate, and the at least one fastener are metal.

20. The guard bar restraint of claim 12, wherein the hook block includes a recess to receive and seat a first end of the at least one fastener.

* * * * *